US005651533A

United States Patent [19]

Ling

[11] Patent Number: 5,651,533

[45] Date of Patent: Jul. 29, 1997

[54] CAP FOR CHAIN LINK FENCE

[76] Inventor: Serge Ling, 112, Des Buttes, Warwick, Québec, Canada, J0A 1M0

[21] Appl. No.: 603,154

[22] Filed: Feb. 20, 1996

[51] Int. Cl.[6] ..... E04F 11/18

[52] U.S. Cl. ..... 256/34; 256/32; 256/1

[58] Field of Search ..... 256/34, 32, 1; 403/2

[56] References Cited

U.S. PATENT DOCUMENTS 4,725,044 2/1988 Cluff ..... 256/34

5,465,941 11/1995 Abbott ..... 256/34

5,482,256 1/1996 Caron ..... 256/34

*Primary Examiner*—Anthony Knight

*Attorney, Agent, or Firm*—Jean H. Dubuc

[57] ABSTRACT

A cap for mounting at one extremity of a pair of tubular slats that extend through openings of a chain link fence formed of interconnected wires defining an open lattice work. The cap comprises a top part and two integral leg portions which are so dimensioned as to be insertable into the open ends of the slats and to be secured in these slats.

7 Claims, 2 Drawing Sheets

CAP FOR CHAIN LINK FENCE

FIELD OF THE INVENTION

The present invention relates to a cap which is adapted to be inserted at the open extremity of a tubular slat that extends through openings of the lattice work of a chain link fence formed of interconnected wires.

BACKGROUND OF THE INVENTION

A chain link fence consists conventionally of metallic wires, covered or not with plastic material, that extend vertically in a zig-zag manner and are interconnected to one another to form loops or openings. Some of these fences are covered with elongated slats which are slid, either vertically or obliquely, in a woven manner, through the rhomboidal-like openings of the lattice work of the fence. One such fence may be found described in U.S. Pat. No. 5,482,256 issued Jan. 9, 1996 to Caron.

OBJECTS AND STATEMENT OF THE INVENTION

The present invention is concerned with providing a cap which is mounted at one end of a pair of tubular slats to ensure that the slats are securely engaged to the fence.

The present invention therefore relates to such a cap which comprises a top portion and a pair of leg portions integrally formed with and depending from the top portion; each leg portion is so shaped as to be insertable into the tubular slat at one open end thereof. Each leg portion has means tightly engaging the slat whereby connection of the cap to a pair of two adjacent slats secures these slats to the fence.

In one preferred form of the invention, each leg portion has a resilient finger which is adapted to be flexed inwardly to slide along the inside wall of the tubular slat and outwardly to extend through a side opening provided adjacent the open end of the slat.

In another form of the invention, the cap is made of plastics material; however, the material is severable at least in the area of the connection of the leg portion to the top portion so that a cap with a single leg portion may be used if required at certain locations of the fence.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

DESCRIPTION OF PREFERRED EMBODIMENTS

Figure 1:
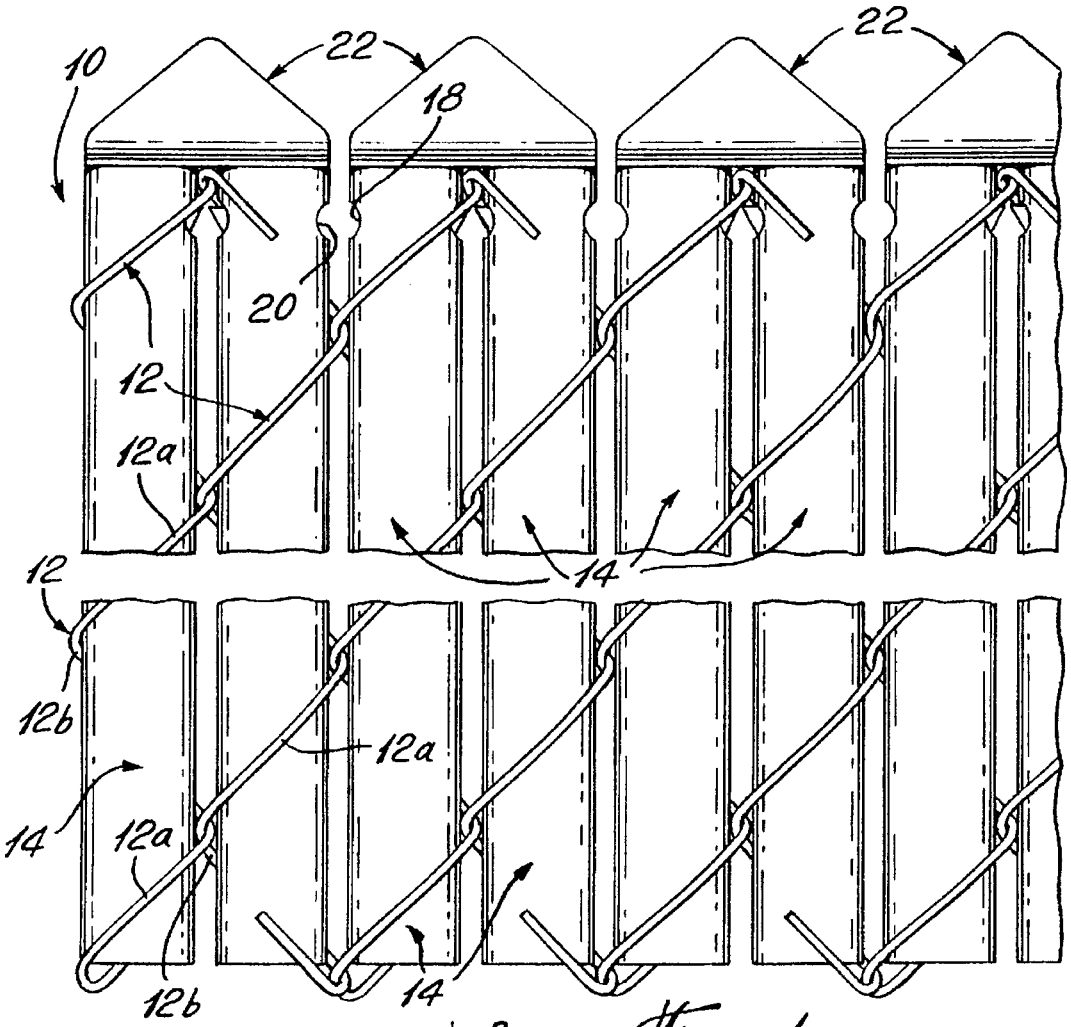
FIG. 1 is an elevation of part of a fence provided with slats and equipped with caps made in accordance with the present invention.

Referring to FIG. 1, there is shown a part of a chain link fence, generally denoted 10, which is formed of interconnected wires 12 that define an open lattice work of rhomboidal openings through which extends a series of elongated slats 14 extending between front and rear runs 12*a* and 12*b* of the wires in a woven fashion. As can be seen from FIG. 5, each slat 14 defines a hollow tubular body, the upper extremity of which defines an open end 16. Adjacent this open end, opposite side openings 18 and 20 are displayed, the function of which will be described further hereinbelow.

As illustrated in FIGS. 1 to 4, a cap, generally denoted 22, is provided for each pair of slats 14. Each cap 22 comprises a triangular shaped top portion 24, from the base of which downwardly extends a pair of leg portions 26 and 28. The width of each leg portion 26, 28 is such as to be able to penetrate into the open end 16 of the tubular slat. Each leg portion has a larger reinforcing flange 26*a*, 28*a*, and an integral finger-like extension 26*b*, 28*b* which is capable of being flexed in and out of a corresponding recessed area 30, 32. The cap is entirely made of plastics material so that depending on the thickness of the fingers' lower areas 34, 36 connecting them to their corresponding flanges 26*a*, 28*a*, the hinge movement of the fingers will be more or less flexible.

Figure 2:
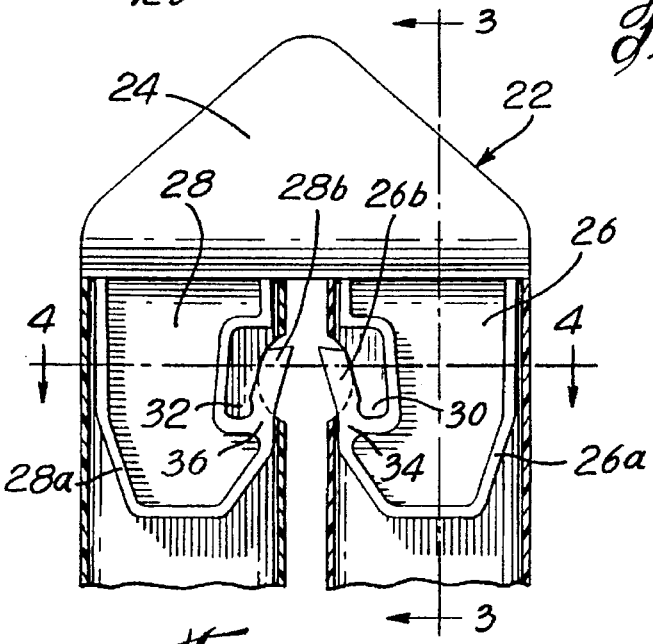
FIG. 2 is an elevational cross-sectional view showing the engagement of one cap to a pair of slats.
Figure 3:
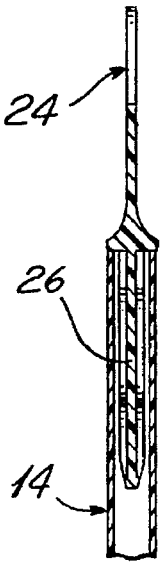
FIG. 3 is a cross-sectional view taken along lines 3—3 of FIG. 2.
Figure 5:
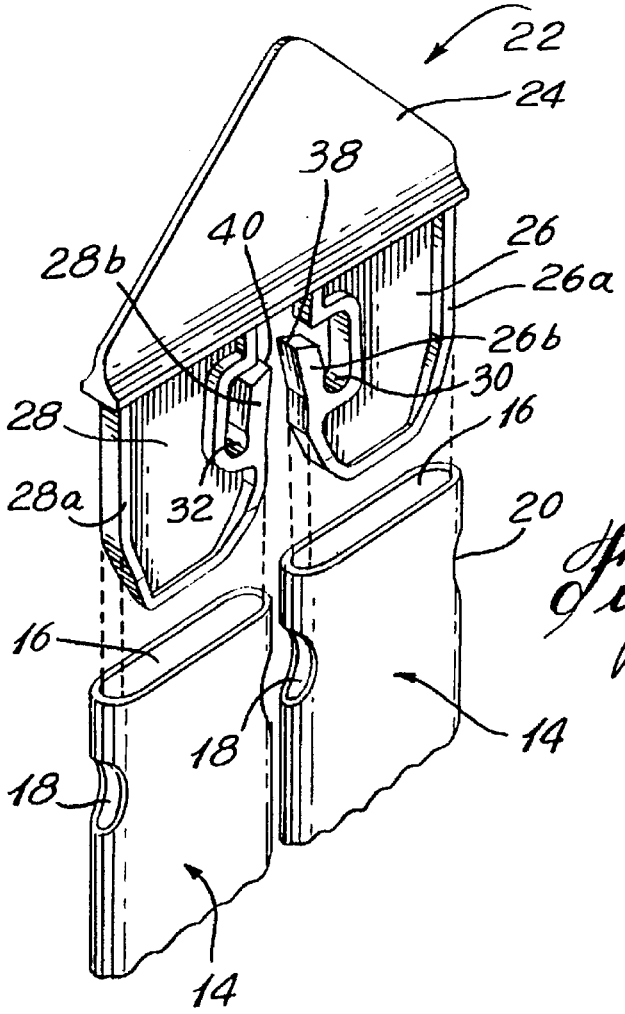
FIG. 5 is an exploded view showing the cap in relation to the extremities of a pair of slats.
Figure 4:
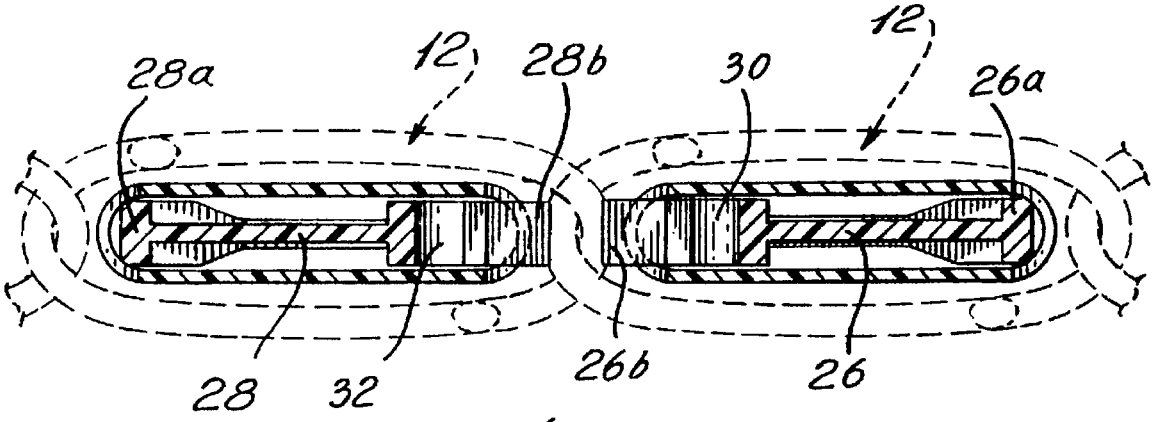
FIG. 4 is a cross-sectional view taken along lines 4—4 of FIG. 2.

Referring to FIG. 5, as the cap 22 is inserted into the open ends 16 of two adjacent slats 14, the opposite facing upper edges 38 and 40 of the fingers 26*b* and 28*b* will contact and slide along the inside wall of the tubular slats, the fingers being flexed inwardly into their corresponding recessed areas 30 and 32. As the fingers 26*b* and 28*b* reach their corresponding side openings 18 and 20 of the slats, they flex outwardly, slightly protruding outside the side openings (as can be seen in FIG. 2) and thus providing some securement to the connection of the slats to the cap.

The plastics material used for the cap is preferably one which is severable, at least in the area of the connection of the leg portions to the top portion so that, in certain cases where the post of a fence or the connecting bar of the fence post makes it impossible to have a slat in the immediate proximity of the post or bar. In such cases, one leg portion is cut off so that the cap with its remaining leg portion may engage a single slat.

Although the invention has been described above with respect with one specific form, it will be evident to a person skilled in the art that it may be modified and refined in various ways. It is evident that, if slats extend obliquely to the fence, the cap may still be used to secure them in place. It is therefore wished to have it understood that the present invention should not be limited in scope, except by the terms of the following claims.

The embodiments of the invention in which an exclusive property or privilege is claimed are defined as follows:

1. For use with a chain link fence formed of interconnected wires defining an open lattice work of openings and wherein a series of elongated slats extend in pairs through said openings to at least partly conceal said openings, each said slat being formed of a hollow elongated tubular member having at least one open end; a cap for connecting a pair of adjacent slats at said open ends thereof; said cap comprising a top portion adapted to cover two adjacent open ends of a pair of two adjacent slats only and a pair of leg portions integrally formed with and depending from said top portion; each said pair of leg portions being so shaped as to be insertable into said two adjacent open ends of said pair of two adjacent slats; each said leg portion of said cap having means tightly engaging a corresponding one of said two adjacent slats whereby engagement of each cap to a pair of slats secures said slats in tandem to said fence.

2. A cap as defined in claim 1, wherein said cap is made of plastics material.

3. A cap as defined in claim 2, wherein said engaging means of each said leg portion include a resilient finger adapted to be flexed inwardly to thereby slide along the inner wall of said tubular member and outwardly to engage a corresponding opening provided adjacent said open end of said slat.

4. A cap as defined in claim 3, wherein the fingers of the two leg portions of a cap face one another.

5. A cap as defined in claim 3, wherein each said leg portion has a recessed area into which said finger may be flexed.

6. A cap as defined in claim 3, wherein said leg portion is severable adjacent said top portion so that said cap may engage the open end of a single slat.

7. A cap as defined in claim 1, wherein said top portion of said cap has a triangular shape.

* * * * *